United States Patent [19]

Wenker

[11] Patent Number: 4,622,927

[45] Date of Patent: Nov. 18, 1986

[54] INTERNAL COMBUSTION ENGINE

[76] Inventor: Ludwig Wenker, Steinerstr. 1, 8543 Hipoltstein-Hofstetten, Fed. Rep. of Germany

[21] Appl. No.: 702,452

[22] Filed: Feb. 19, 1985

[30] Foreign Application Priority Data

Feb. 18, 1984 [DE] Fed. Rep. of Germany ..... 3405893

[51] Int. Cl.[4] ..... F02B 75/04

[52] U.S. Cl. ..... 123/58 B; 74/60; 123/58 BC

[58] Field of Search ..... 123/58 R, 58 B, 58 BA, 123/58 BB, 58 BC, 81 R, 81 C; 74/60, 839

[56] References Cited

U.S. PATENT DOCUMENTS

| | | | |
|---|---|---|---|
| 1,476,275 | 12/1923 | Wishon | 123/58 BC |
| 1,688,294 | 10/1928 | Haltenberger | 123/81 C |
| 1,878,325 | 9/1932 | Ricardo | 123/81 C |
| 2,004,693 | 6/1935 | Gilbert | 123/81 C |
| 2,302,995 | 11/1942 | Holmes | 74/60 |
| 2,354,620 | 7/1944 | Smith | 123/58 BC |
| 2,421,868 | 6/1947 | Bovee | 123/58 BC |
| 2,957,462 | 10/1960 | Clark | 123/58 BC |
| 3,263,513 | 8/1966 | Girodin | 74/60 |
| 3,319,874 | 5/1967 | Welsh et al. | 123/58 BA |
| 4,489,682 | 12/1984 | Kenny | 123/78 F |

FOREIGN PATENT DOCUMENTS

| | | | |
|---|---|---|---|
| 625854 | 9/1961 | Italy | 123/58 BA |

*Primary Examiner*—Craig R. Feinberg

*Attorney, Agent, or Firm*—Karl F. Ross; Herbert Dubno

[57] ABSTRACT

An internal combustion engine includes four cylinders arranged concentrically about a driving shaft and each having two opposing pistons which are linked to wobble elements via respective connecting rods. The wobble elements are supported by the driving shaft and transmit the movement of the pistons into a rotational movement of the driving shaft. Each wobble element consists of two portions which are rotatable relative to each other about a wobble axis extending transversely to the driving shaft. The connection of the wobble portions is provided via a collar which is fixed onto the driving shaft. The connecting rods of two diametrically opposing pistons are linked to each wobble portion which are guided in respective guideways extending parallel to the driving shaft.

19 Claims, 5 Drawing Figures

INTERNAL COMBUSTION ENGINE

FIELD OF THE INVENTION

My present invention relates to an internal combustion engine and, more particularly, to an internal combustion engine having four mutually parallel cylinders concentrically arranged about an output shaft whereby each cylinder has two opposing pistons acting upon the output shaft via connecting rods and wobble elements.

BACKGROUND OF THE INVENTION

An internal combustion engine using wobble elements to generate torque is described in U.S. Pat. No. 2,513,083 in which each wobble element consists of a hollow circular ring body and a circular disk pivotally supported within the ring body. The disk is linked with the output shaft in a non-rotatable manner (i.e. is constrained to rotate with the shaft) and is supported at an angle thereto. From the outer peripheral areas of the ring body radially project pins which engege in stationary guide slots extending parallel to the output shaft.

This system has, however, the disadvantage that the four pins of each ring body are subjected to a considerable stress within the guide slots since they are axially displaced in the slots under load and simultaneously laterally pressed and twisted against the slot walls. This causes a dissipation of a major portion of the drive power transmitted by the pistons. Moreover, the mechanical wear between the pins and the guide slots is rather high and a reliable lubrication in this area is also very difficult, thus resulting in a very low working speed of the internal combustion engine.

In U.S. Pat. No. 1,476,275, an internal combustion engine is disclosed in which each wobble element has a circular gear rim at its inner side facing the housing of the engine. Cooperating with the gear rim is a further congruent gear rim fixed to the housing. The gear rim of the wobble element rolls upon the gear rim of the housing in order to prevent the wobble element from rotating with the output shaft.

This leads to a significant mechanical wear and to undesired running noises between the gear rims.

A further drawback is that the support of the connecting rods of all pistons have fixed arc spacings in a circumferential direction of the wobble element which results in a bending of the connecting rods perpendicular to the piston pins during the wobble motion of the wobble element, these bending stresses being transmitted onto the pistons within the cylinders. Due to the resulting kinematic swinging movement of each connecting rod about the piston pin, an oscillating motion is obtained for each piston so that the cylinder wall is unevenly loaded which results in considerable mechanical wear.

OBJECTS OF THE INVENTION

It is thus the principal object of my invention to provide an internal combustion engine obviating the aforestated drawbacks.

In particular, it is an object of my invention to provide an internal combustion engine which is simple, safe and has a compact structure and in which the pistons run within the cylinders without significant tilting or canting loads.

SUMMARY OF THE INVENTION

I realize these objects, according to the present invention, by providing each wobble element from two halves which are rotatable relative to one another about a wobble axis extending obliquely or at an angle to the output shaft. The portions or halves of the wobble element act via a collar and bearing means upon the output shaft and each has arms pivotally linked to the connecting rods of two diametrically opposite pistons.

In order to provide an exact guidance of the wobble elements, each portion or half engages in a guide which is fixed to the housing of the engine and provided with a respective guideway extending parallel to the output shaft. In these guides predetermined and negligible friction conditions can be ensured.

According to another feature of the invention, the compression exerted by the pistons in the combustion chambers can be adjusted by a bushing which is mounted on the output shaft via a coarse (steep-pitch) thread and on which the collar is fixed. Through suitable means, like a lever linked to the bushing, the latter together with the collar can be shifted in axial direction, thus adjusting the compression within the cylinders.

The control of the fuel supply and discharge of exhaust gases is provided by the rotary or axial movement of the cylinder bushings which are located in between the outer cylinder jacket of the cylinders and the pistons. The cylinder bushings of each cylinder are actuated by control means which include a reduction gear to transmit the rotational movement of the output shaft onto a common camshaft. The camshaft can be provided at each axial end thereof with a cam wheel which cooperates with respective control rings located at the axial ends of the cylinder bushings. The cooperation between the cam wheels and the control rings is obtained through respective cams (of the cam wheels) and counter cams or cam followers (on the control rings). Through suitable spring means, a close and continuous contact is maintained between the counter cam and the cam wheels.

An important advantage of the invention is that the angular or arc distances or spacings determined in circumferential direction of the arms of the wobble element are not fixed and the arms are not rigidly spaced because both portions or halves of each wobble element can rotate at least limitedly relative to each other. Thus, there are no lateral loads on the connecting rods during the wobbling motion of the wobble elements; rather, the connecting rods execute only minimal swinging motions in radial plane in relation to the output shaft. The pistons run essentially without jamming as the connecting rods can be essentially in alignment with the cylinder axes over the entire stroke movement of the pistons. Due to the low strain, the connecting rods can be made very light and short so that the wobble elements can be provided close to the cylinders. This results in a very compact construction of the engine.

Finally, I may note that, due to the simple structure of the guides and the short and light connecting rods as well as the jam-free running of the pistons, a high working speed of the combustion engine is possible with an improved efficiency in comparison to prior-art combustion engines.

BREIF DESCRIPTION OF THE DRAWING

The above and other features of my present invention will now be described in more detail with reference to the accompanying highly diagrammatic and representational drawing in which.

SPECIFIC DESCRIPTION

Figure 1:
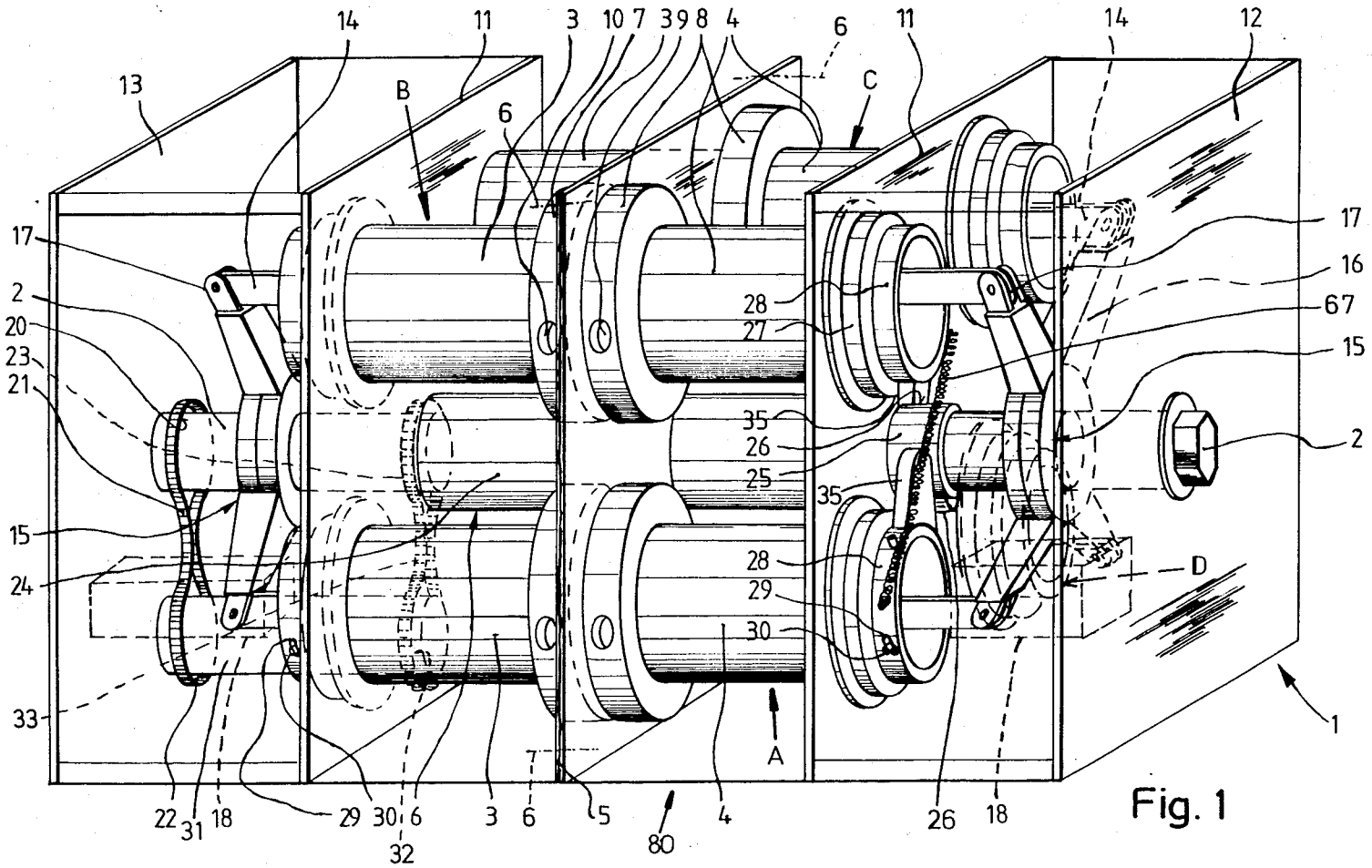
FIG. 1 is a perspective view in schematic form of an internal combustion engine according to the invention.

FIG. 1 shows an internal combustion engine 80 having a parallelepipedal housing 1 which is parted into different replaceable parts forming chambers defined by opposing end plates 12, 13 and intermediate transverse walls 11 spaced from the respective end plates 12, 13.

Arranged between the transverse walls 11 are two plates 5 extending parallel to the walls 11 and joined to each other via suitable connecting elements such as bolts represented by dash-dot lines 6. Consequently, the housing 1 is separable into two portions in longitudinal direction thereof along the plates 5 which thus define a partition plane of the housing 1.

Traversing the housing in longitudinal direction at a central portion thereof is an output shaft 2 which is concentrically surrounded by four cylinders A,B,C,D extending parallel to the shaft 2 between the end plates 12, 13. The shaft 2 is supported in bearings 74 provided in or on the end plates 12, 13.

Each of the cylinders A,B,C,D consists of two axially aligned cylinder jackets or sleeves 3, 4 arranged in elongation or extension of each other and each extending in an associated chamber defined by the respective transverse wall 11 and the partition plane 5.

Adjacent to the partition wall 5, each cylinder jacket 3, 4 is provided with an annular flange portion 7 or 8 accommodating a supply duct and discharge duct, respectively, through which a fresh fuel-air mixture is introduced into or from which exhaust gas is discharged from the combustion chamber defined within each cylinder A,B,C,D, in a manner to be described hereinbelow. Each flange portion 7, 8 is connected via openings 9 or 10 to a supply or discharge system like a carburetor (not shown) via an intake manifold or an exhaust system (not shown) such as an exhaust manifold.

Figure 3:
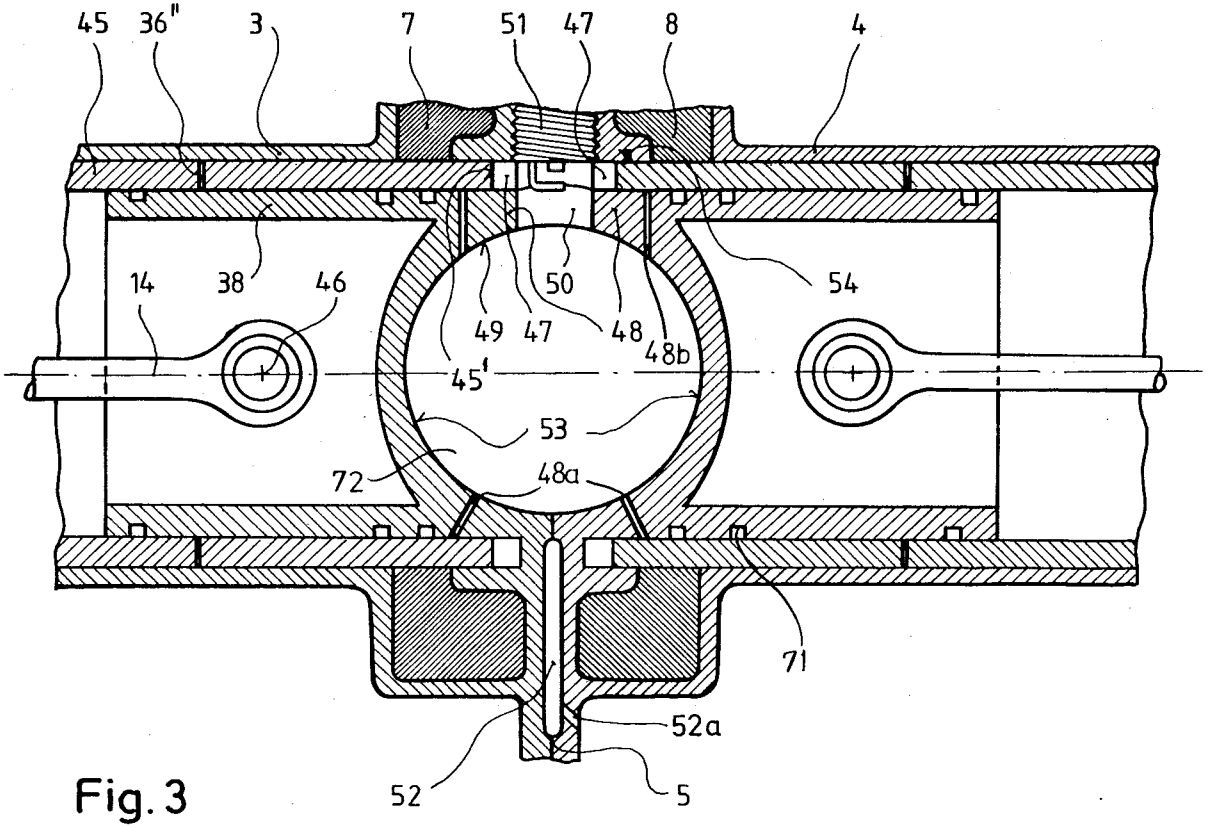
FIG. 3 is a detailed illustration of a combustion chamber of the combustion engine of FIG. 1.

Turning now in particular to FIG. 3, it can be seen that each cylinder jacket 3, 4 surrounds a cylindrical bushing 45 which is movable in axial direction within the cylinder jacket 3, 4 so as to control the entrance to the discharge or supply ducts 7, 8. At the partition plane 5, each cylinder jacket 3, 4 is integrally provided with a radially inwardly extending annular projection 48 serving as a squeeze head and extending at a right angle (**48*b*) from the jacket 3, 4, as indicated in the upper portion of FIG. 3, or at a different angle (48*a*), as illustrated in the lower portion of FIG. 3. The latter projections 48 are concave tapered and define at the upper portion a centered through passage 50 into which a spark 51 is inserted. In elongation of the bushings 45, the projections 48 are provided with a circumferential groove 47 into which the free ends 45' of the bushings 45 protrude for sealing off the access to the supply and discharge ducts within the flange portions 7, 8.**

The provision of the grooves 47 creates also a desired sealing of the cylinder bushings 45 since the gas prevailing in the grooves 47 will be compressed by the protruding ends 45' of the bushings 45 so that a gas cushion is formed.

The position illustrated in FIG. 3 shows the compression stage shortly before ignition point so that the access to the supply and discharge ducts 7, 8 is closed off.

Accommodated within each cylinder A,B,C,D and running along the respective bushing 45 are two coaxial pistons 38 which thus diametrically face each other and run in opposite direction. At its opposing ends, each piston 38 is adapted to the contour of the facign projections 48 and thus defines a calotte-shaped indentation 53 at its lower portion and a rounding 49 at its upper portion.

Consequently, the pistons 38 of each cylinder A,B,C,D are movable toward the projections 48 and define with their opposing ends and the projections 48 a spherical combustion chamber 72.

When a spherical combustion chamber is not required, it is sufficient to provide the annular areas 54 of the ring flanges 7, 8 with an abutment for the free ends 45' of the cylinder bushings 45 against which abutment the bushings 45 can be supported during the explosion pressure within the combustion chamber and can be sealed toward the outside.

To eliminate or distribute the cylinder heat, a coolant flows in the space between the walls 11 via respective pipes (not shown) and over and around the cylinder jackets 3, 4 of each cylinder A,B,C,D via coolant channels 52 which communicate with channel **52*a*** for supply of the coolant.

Each piston 38 is further linked to one end of a connecting rod 14 (which acts in compression or tension) via a conventional piston pin 46 or via a ball-and-socket joint (not shown) for transmitting the axial motion of the pistons 38 to the output shaft 2 as will now be described.

At its other end, each connecting rod 14 of one cylinder A,B,C,D is linked via a Cardan (universal) joint 17 or via a ball-and-socket joint which includes a ball end 44 and ball joint bearing 43 (see FIG. 2, lower portion) to a wobble element 15 which is journaled relative to the output shaft 2, the journal having a preset wobble axis 15'. The wobble axis 15' is indicated by dash-dot lines (FIG. 2) and extends obliquely or at an angle to the output shaft 2.

Figure 2:
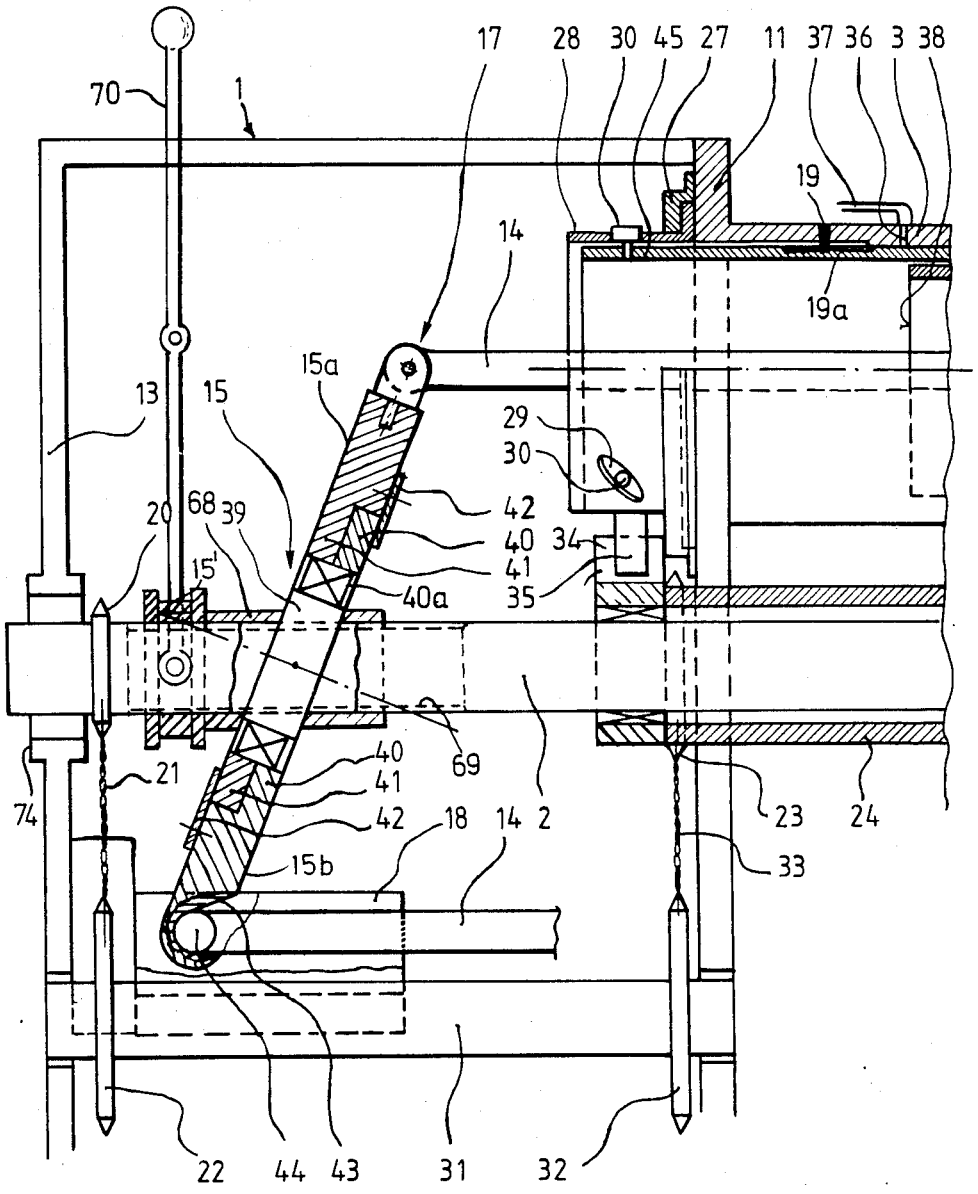
FIG. 2 is a longitudinal section of the left section of the internal combustion engine of FIG. 1.

Turning now especially to FIG. 2 which shows in more detail the structure and support of each wobble element 15, it can be seen that each wobble element 15 is divided into two portions or halves **15*a*, 15*b* which are pivotable relative to each other about the preset axis 15'. Each portions 15*a*, 15*b* has rigidly affixed thereto two diametrically opposite arms 40, 41. The portions 15*a*, 15*b* and the respective arms are journaled via a bearing 40*a* on a base member or collar 39 which is connected to the output shaft 2. Through a locking plate 42 which is fixed to either one of the wobble arms 40, 41 and covers a major portion of the arms 40, 41, the latter are prevented from being separated apart in axial direction. As shown by the longitudinal section of FIG. 2, the wobble portions 15*a*, 15*b* oppose each other in any rotational position of the output shaft 2 but are also arranged in a cross-shaped manner. The collar 39 is connected to the output shaft 2 via a bushing 68 which is provided with a coarse or steep-pitch thread so as to be axially movable along the shaft 2. Through displacement of the bushing 68 by means of a lever 70—even advantageously during operation of the combustion engine—the compression exerted by the pistons 38** can be controlled.

As shown in FIG. 2, the collar 39 is provided on the output shaft 2 in an inclined position. The collar 39 is not only inclined to the shaft in the plane of the paper but also is inclined transversely to the plane of the paper or drawing so that a thrust of a piston 38, e.g. by the upper piston 38 in FIG. 2, toward the left will cause the wobble element 15 to tilt toward the left as well, thereby simultaneously rotating the output shaft 2. Thus, a torque is applied to the output shaft 2 via the wobble element 15.

Located at and connected to each of the end plates 12, 13 are two guides 18 for providing a parallel guidance of the free ends 16 of each wobble element 15. Each guide 18 is provided with guideways extending parallel to the output shaft 2 and engageable by the respective ends 16 of the associated wobble arms 40 or 41. Advantageously, one such guide is provided for one arm of each of the wobble element halves 15*a*, 15*b* of each wobble element 15.

Arranged coaxially along the output shaft 2 and rotatable thereon is a camshaft 24 which extends with its both end portions beyond the transverse walls 11. As can be seen from FIG. 2, a chain wheel or sprocket 23 is fixedly connected to the camshaft 24 just beyond the transverse wall 11 located on the left hand side in FIG. 2 and cooperates with a chain wheel or sprocket 32 via an endless chain 33. The chain wheel 32 is arranged at one end of a shaft 31 which extends parallel to the output shaft 2 and is supported by the end plate 13 and the transverse wall 11. The other end of the shaft 31 is supported in the end plate 13 and carries a further chain wheel or sprocket 22 which cooperates via a chain 21 with a chain wheel or sprocket 20. The chain wheel 20 is supported on the output shaft 2 at a distance to the wobble elements 15 in vicinity of the end plate 13.

Located on the end portion projecting beyond the left hand transverse wall 11, camshaft 24 is also provided adjacent to the chain wheel 23 with a cam wheel 34 carrying cams 26.

Likewise, at the other end portion projecting from the right hand transverse wall 11 (see FIG. 1), the camshaft 24 supports a cam wheel 25 (FIG. 1) which is provided with cams 26 as well.

Each cylinder A,B,C,D is further associated with two ring flanges 27 respectively connected to the transverse walls 11. Each flange 27 provides a pivot bearing for a control ring 28 which is thus rotatably arranged and in exact alignment on the corresponding cylinder axis. Spaced along its circumference, each control ring 28 is provided with a plurality of oblique grooves 29 which are engageable by followers 30, e.g. slide rings. The followers 30 are fixedly connected to the associated cylinder bushing 45 so as to displace the cylinder bushing corresponding to the actuation of the control ring 28. Instead of the described forced coulisse-like linkage between the bushings 45 and the associated control ring 28, a coarse thread may also be used therebetween.

Each control ring 28 is further provided with a counter cam 35 which cooperates with the respective cam 26 of the associated cam wheel 25, 34. In order to provide a continuous and close engagement of the counter cams 35 of the control rings 28 with the cam wheels 25, 34, spring elements 67 (only one shown in FIG. 1) are provided.

For allowing a displacement of the cylinder bushings 45 only in axial direction and thus preventing a rotational movement thereof, each bushing 45 is provided with an elongated groove 19*a* at their outside facing the associated jacket 3, 4. Projecting into the groove 19*a* of each bushing 45 is a pin 19 which is recessed in the respective jacket 3, 4.

During a rotational movement of the camshaft 24, the control rings 28 of all cylinders A,B,C,D are rotated via the cams 26 in synchronization with the respective positions of the pistons 38 running within the bushings 45. This rotational movement causes a displacement of the cylinder bushings 45 in axial direction by means of the grooves 29 and the followers 30 as will be explained hereinbelow.

As is further illustrated in FIG. 2, the jackets 3, 4 are provided with through-passages 36 which communicate with a duct 37 leading to a lubricant supply in order to introduce lubricant into the sliding areas between the cylinder bushings 45 and the jackets 3, 4. Alternatively, the lubricant supply can be provided via through-passages 36' within the bushing 45 as shown in FIG. 3 through which passages 36' the lubricant can be supplied into the space between the bushings 45 and the inner wall of the surrounding jackets 3, 4.

Arranged within and extending along the outer circumference of each piston 38 is a sealing element 71 which prevents a leakage of gas through the space between the pistons 38 and the surrounding bushing 45.

When ignition occurs in the cylinder shown in FIG. 3, the compressed fuel-air mixture within the combustion chamber 72 explodes and drives the diametrically arranged pistons 38 apart and away from each other.

This movement is transmitted via the connecting rods 14 to the wobble arms 40, 41 of the associated wobble elements 15 which in turn cause a rotational motion of the output shaft 2.

Via the chain drives 20, 21, 22 and 32, 33, 23, the rotation of the output shaft 2 is transmitted to the camshaft 24 which displaces the cam 26 and eventually the control rings 28.

Thus, since in this embodiment the internal combustion engine operates according to the four-cycle engine or Otto cycle principle, towards the end of the expansion stroke of both pistons 38, the cylinder bushing 45 illustrated on the left in FIG. 3 is displaced in axial direction toward the left until the access to the discharge duct 7 is sealed off.

The displacement of the bushing 45 is obtained by the rotational motion of the control ring 28 and the cooperation of the slots 29 with the followers 30.

In the meantime, the output shaft 2 is caused to further rotate by the successive expansions within the other cylinders so that, eventually, the pistons 38 in FIG. 3 approach each other again, thereby forcing exhaust gas through the discharge duct 7 before the cam 26 (FIG. 2) causes an actuation of the control ring 28 and thus a displacement of the left bushing 45 into the position of FIG. 3 in which the discharge duct 7 is sealed off.

Thereafter, or with a predetermined overlapping, the right-hand cylinder bushing 45 (FIG. 3) will be displaced to the right by the associated control ring 28 until supply duct 8 is opened so that upon further movement of the piston apart from each other, a fresh fuel-air mixture can be drawn in.

Before both pistons 38 of this cylinder approach each other again, the right cylinder bushing 45 is displaced to the left until projecting into the groove 47 and sealing off the supply duct 8. Consequently, the fuel-air mixture will be compressed until the pistons 38 occupy the position of FIG. 3 and a new expansion cycle starts.

Figure 4:
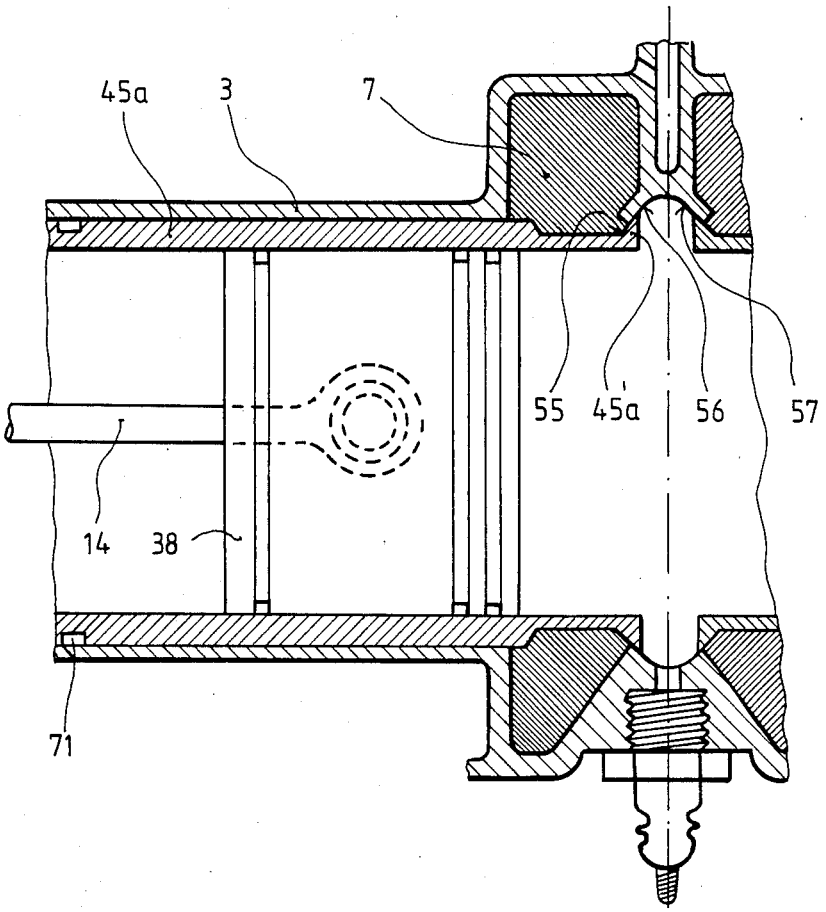
FIG. 4 is a sectional view of a cylinder head of the combustion engine according to the invention.

Turning now to the embodiment of FIG. 4, it may be seen that the opposing ends of the associated cylinder bushings 45*a* are provided with funnel-shaped projections 45*a'* which have sealing surfaces 55. At the partition plane 5, the cylinder jackets 3, 4 are provided with inwardly directed concave or inwardly bulged expansions 57 defining valve seats 56. The projections 45*a'* cooperate with the valve seats 56 like poppet valves to open or close the discharge and supply ducts 7, 8. For connecting the combustion chamber with the discharge duct 7 and supply duct 8, one of the cylinder bushings 45*a* is shifted toward the other so as to be displaced from the valve seat 56. In this embodiment, the pistons 38 approach each other to a further degree as in the embodiment of FIG. 3 in which a spherical combustion chamber is illustrated. If necessary, the piston heads can be provided with squeeze edges for obtaining an improved whirling of the fuel-air mixture.

Figure 5:
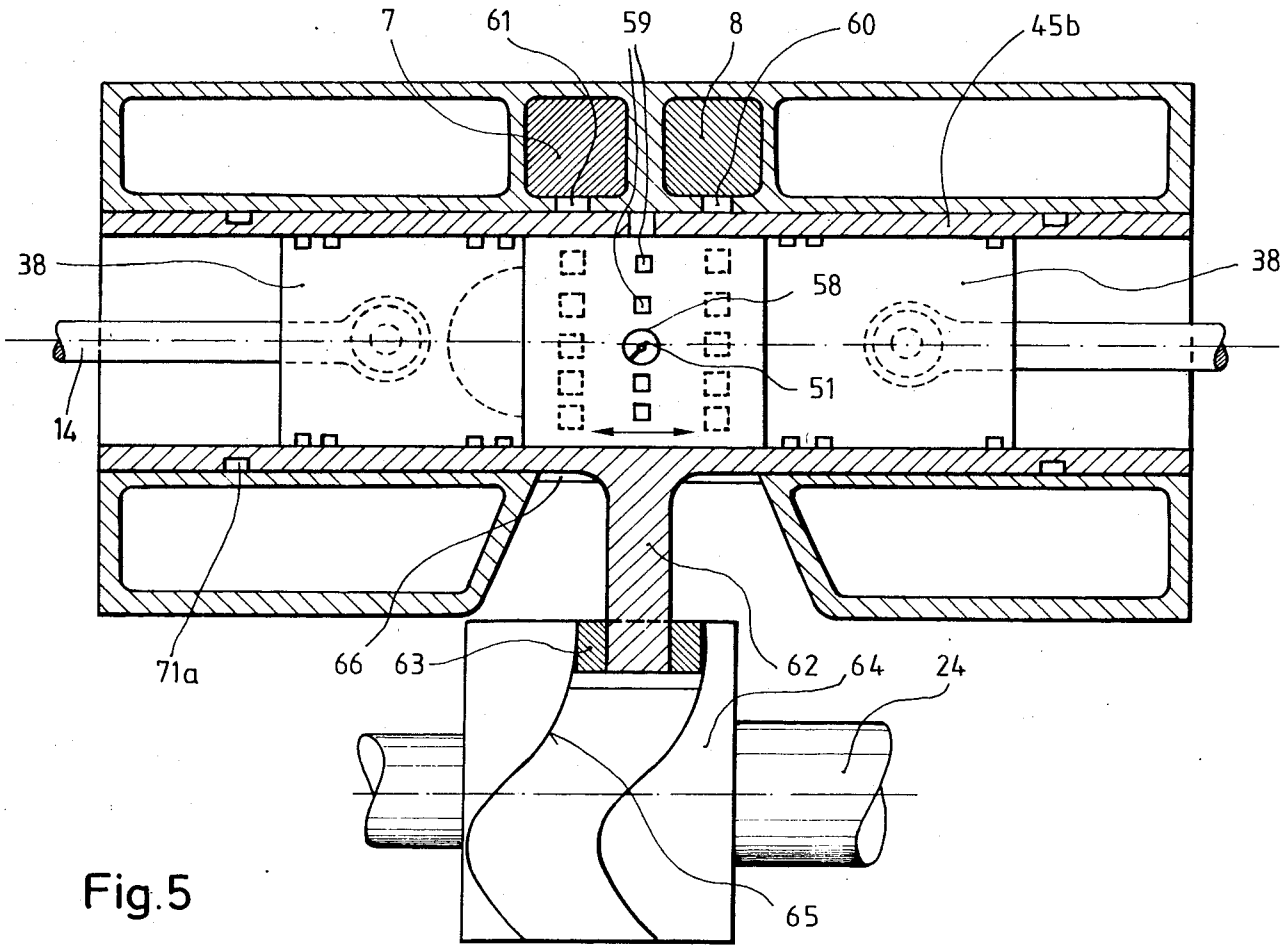
FIG. 5 is a sectional view of another embodiment of a cylinder head of a combustion engine according to the invention.

In the embodiment of FIG. 5, the cylinder jackets 3, 4 are traversed by a one-piece cylinder bushing 45*b* which is provided with an ignition opening 58 and a plurality of passages 59 arranged at a central area of the bushing 45*b* and spaced in circumferential direction thereof. The cylinder bushing 45*b* is shiftable between a central position as shown in FIG. 5 and left and right end positions as indicated by arrow 73. When the bushing 45*b* occupies its central position, the passages 59 are sealed off by the inner wall of the jackets 3, 4, and spark 51 is aligned with the ignition opening 58.

In the left end position, the passages 59 (indicated by dotted lines) of the bushing 45*b* as well as the ignition opening 58 is in communication via respective openings 61 with the discharge duct 7, while in the right end position the passages 59 (indicated by dotted lines) and the ignition opening 58 communicate via respective openings 60 with the supply duct 8. The control and thus the displacement of the bushing 45*b* is provided by a single cam wheel 64 which is arranged on the camshaft 24. The cam wheel 64 has a wavelike guideway 65 in circumferential direction along which a follower 63 is movable. The follower 63 is fixedly connected to a transverse pin 62 which is an integral part of the bushing 45*b* and is movable along a guideway 66 in the bushing 45*b* only in parallel direction to the cylinder axis.

In the embodiments of FIG. 4 and 5, seals 71, 71*a* are provided for preventing gas leakage between the bushings 45*a*, 45*b* and the surrounding jackets 3, 4.

The internal combustion engine, according to the invention, can also be run in a two-cycle operation which does not necessitate movable cylinder bushings. Rather, the stationary bushing is provided with conventional piston ports which are alternatingly passed by the pistons running with a certain lag.

Upon suitable dimensioning of the grooves 47 and their alignment with the free ends 45' of the bushings 45, the air gap toward the combustion chamber is larger than the air gap toward the discharge and supply ducts 7, 8 since the medium enclosed in the groove 47 and compressed by the end 45' is effective against the explosion pressure within the combustion chamber. Under these circumstances, gap losses are negligible.

It is advantageous to provide the free end 45' of the cylinder bushings 45 with a toothing so as to bring about an automatic removal of deposited oil carbon and to moderate or dampen shock stresses from the gas pressure. As combustion residues deposit within the annular grooves 47, increasing gap losses through wear are obtained. Thus, higher gap losses and grooves having a compression space reduced by residues correlate with each other. Resiliencies as occurring in conventional valves are precluded through my invention since the sealing of the bushings 45 is essentially obtained without any metallic contact. Wear and emission of noise are also clearly reduced.

It is obvious that the internal combustion engine according to my invention can also be used as diesel engine. In this case, the injection of diesel fuel is obtained by two nozzles which are arranged to each other in such a manner that the nozzle jets meet in the center of the combustion chamber or impinge on a respective baffle surface within the combustion chamber. When operating as a diesel engine, direct injection is suitable as well as the use of a precombustion chamber. For easy starting, an incombustible heating wire (slow wire) can be stretched transverse to the spherical combustion chamber. The pistons 38 can be formed as sectional pistons having low heat transfer coefficients so that heat losses from the combustion chamber toward the outside can be kept to a minimum.

Although the fuel-air mixture introduced through the duct 8 flows with a high degree of uniformity, guide blades or special design of the supply duct 8 can be provided to obtain a desired whirling of the mixture. Furthermore, it is possible to provide the cams 26 in such a manner that they directly actuate the cylinder bushings 45 either in axial or in radial direction.

The cylinder bushings 45, 45*a*, 45*b* can be made of aluminum, cast iron or profiled steel pipes. Thermally overexposed areas do not occur since the individual parts are very uniform and have continuously the same wall thickness. The cooling system can also be provided in a simple manner.

The explosion pressure is distributed via both pistons 38 to the wobble elements 15 so that the obtained torque transmitted onto the output shaft 2 is of equal magnitude. The pistons can be assembled from several parts so as to provide a superior heat insulation. In addition, the pistons may be parted in axial and/or radial direction and then riveted or screwed together.

In case a valve opening overlap is necessary, the arrangement of the cams is respectively to be adjusted whereby it is possible, e.g. by means of a centrifugal governor, to automatically adjust the overlap during the operation. The adjustment can be provided positively as well as negatively by opposing left-handed and right-handed threads within the countershaft, that is between both pairs of chain wheels.

Especially advantageous is the fact that, due to the guidance of the arms of the wobble elements and their division into two portions, the radial relative movements in circumferential direction of the link of the connecting rod together with the associated one of the wobble arms are extremely small so that the connecting rods 14 and the pistons 38 are not subjected to a significant degree to lateral loads. Consequently, the connecting rods 14 can be provided in a very thin, light and simple manner and be produced inexpensively. This is also true for the connection of the connecting rods 14 with the pistons 38 and the wobble elements 15.

The internal combustion engine is especially suitable for leadfree gas since the pressure increase is reduced after the ignition more rapidly than in conventional engines as the expansion of the volume is obtained in both directions by the driving of two pistons apart. Knocking is also considerably reduced. In addition, since the connecting rods are hardly deflected, friction losses during higher speeds is diminished since the pistons 38 are not subjected to significant lateral forces. In view of the negligible occurrence of lateral forces, the connecting rods can be made of simple pipes and be used for supply of lubricant.

Further, the negligible deflection of the connecting rods 14 allows the use of larger pistons, i.e. with narrower tolerances as in conventional engines so that gap losses between piston and cylinder running path are kept to a minimum while heat transfer is improved. In case an improved heat transfer is not desired, the pistons can be developed in such a manner that they run with contact along the cylinder running path only at those sealing areas along which piston rings are also located.

Especially advantageous is also the omission of compensation weights or counterweights for compensation of inertia forces of first degree.

In the cylinder bushings 45*a* according to FIG. 4, the valve edge can be formed by shortening of a pipe or by rolling or by friction welding.

Since the cylinder bushings 45, 45*a*, 45*b* are guided along a major area within the cylinders A,B,C,D and the small deflections of the connecting rods 14 are subjected only to low friction, the specific sliding friction is low so that a lubrication with thermal oil is sufficient. It is also possible to choose a higher operational temperature of the engine because the heat elimination is rather favorable.

The transmission of force from the output shaft to the individual cylinders or cams controlling the cylinder bushings can also be obtained via toothed wheels or planet wheels. Moreover, it is possible to use a revolving chain or toothed belt from the output shaft 2 and wrapping all cylinders in order to trigger automatically all control movements.

I claim:

1. An internal combustion engine, comprising:

a housing;

an output shaft journaled in said housing;

an array of four cylinders on said housing disposed around said output shaft and parallel thereto, each of said cylinders defining a cylinder axis and having two pistons moving in opposite directions;

a respective wobble element on said shaft operatively connected with a respective set of pistons on a respective side of said array of cylinders, each of said wobble elements having two identical halves angularly displaceable relative to one another about a respective wobble axis lying at an angle with respect to said output shaft, each of said halves having a pair of arms connected pivotally to diametrically opposite ones of said pistons and interdigitated with the pair of arms of the other of said halves, the arms of each half projecting toward the other half so that pivots connecting said arms to said pistons all lie in the same plane for each wobble element; and means on said housing for guiding at least one of the halves of each wobble element for movement parallel to said output shaft.

2. An internal combustion engine as defined in claim 1 wherein the pistons of each cylinder define a combustion chamber within each cylinder, said housing being divided into several compartments and being parted along a central area of said combustion chamber.

3. An internal combustion engine as defined in claim 1 wherein each of said cylinders includes an outer cylinder jacket and at least one cylinder bushing arranged in between said cylinder jacket and said pistons and serving as a valve element for controlling inlet to and outlet from a combustion chamber defined between pistons of a respective cylinder, and further comprising shifting means for moving said cylinder bushing in axial direction in dependence on the movement of said pistons.

4. An internal combustion engine as defined in claim 3 wherein only one such cylinder bushing traverses said cylinder jacket of the respective one of said cylinders and includes at least one row of circumferential passages, said cylinder bushing being movable between a first position in which said passages are in alignment with an inlet duct to allow supply of fuel into the combustion chamber, a second central position in which said passages are sealed off and ignition occurs and a third position in which said passages are in alignment with an outlet duct to allow discharge of exhaust gases from the combustion chamber.

5. An internal combustion engine as defined in claim 1, further comprising connecting rods each having one end linked to one of said arms and another end linked to a respective one of said pistons.

6. An internal combustion engine as defined in claim 5 wherein said means for guiding includes a guide for each of said halves of a respective wobble element and having a guideway which extends parallel to said output shaft and is engaged by a respective one of said arms.

7. An internal combustion engine as defined in claim 6, further comprising a collar fixed to said shaft in an inclined manner, and a bearing for each of said halves of said wobble element for pivotally supporting each of said halves on said collar.

8. An internal combustion engine as defined in claim 7, further comprising shifting means for moving said collar on said output shaft in axial direction.

9. An internal combustion engine as defined in claim 8 wherein said shifting means includes a bushing connected to said output shaft via a coarse thread, said collar being supported by said bushing so as to be axially movable when said bushing is shifted along said output shaft.

10. An internal combustion engine as defined in claim 9, further comprising a ball-and-socket joint for linking each of said connecting rods to a respective one of said arms.

11. An internal combustion engine comprising a housing;

an output shaft journaled in said housing;

an array of four cylinders on said housing disposed around said output shaft and parallel thereto, each of said cylinders defining a cylinder axis and having two pistons moving in opposite directions;

a respective wobble element on said shaft operatively connected with a respective set of pistons on a respective side of said array of cylinders, each of said wobble elements having two halves angularly displaceable relative to one another about a respective wobble axis lying at an angle with respect to said output shaft, each of said halves having a pair of arms connected to diametrically opposite ones of said pistons;

means on said housing for guiding at least one of the halves of each wobble element for movement parallel to said output shaft, each of said cylinders including an outer cylinder jacket and at least one cylinder bushing arranged between said cylinder jacket and said pistons and serving as a valve element for controlling inlet to and outlet from a combustion chamber defined between pistons of a respective cylinder; and shifting means for moving said cylinder bushing in axial direction in dependence on the movement of said pistons, said shifting means including a hollow camshaft surrounding and rotatably supported on said output shaft, said camshaft extending in axial direction between said wobble element and being indirectly driven by said output shaft.

12. An internal combustion engine as defined in claim 11 wherein said shifting means further includes a reduction gear for connecting said output shaft with said camshaft.

13. An internal combustion engine as defined in claim 12 wherein said reduction gear is a chain drive.

14. An internal combustion engine as defined in claim 11 wherein each cylinder includes two diametrically opposing cylinder bushings, said shifting means further including a control ring arranged on each of said cylinder bushings at a location remote to said combustion chamber and being actuated by said camshaft, and further including a force connecting between said control rings and said cylinder bushings so that a rotational motion of said control rings about said cylinder axis causes a movement of said cylinder bushings in axial direction.

15. An internal combustion engine as defined in claim 14 wherein said outer jacket has a circumferential expansion facing toward the combustion chamber and defining a valve seat, the opposing ends of said cylinder bushings in vicinity of the combustion chamber being funnel-shaped and cooperating with said valve seat of said expansion in a poppet-valve-like manner.

16. An internal combustion engine as defined in claim 14 wherein said camshaft supports at its axial ends a cam wheel provided with cams, each of said control rings having a counter cam which is aligned with the respective one of said cams so as to provide the actuation of said control rings by said camshaft.

17. An internal combustion engine as defined in claim 16 and further comprising spring means for urging said counter cams continuously against said cam wheels.

18. An internal combustion engine as defined in claim 14, wherein each of said control rings is provided with at least one groove extending transversely to said cylinder axis, and further comprising a follower projecting from said cylinder bushings into said groove to provide the force connection between said control rings and said cylinder bushings.

19. An internal combustion engine as defined in claim 18 wherein said follower is a slide ring.

* * * * *